US008030853B1

(12) United States Patent
Wong et al.

(10) Patent No.: US 8,030,853 B1
(45) Date of Patent: Oct. 4, 2011

(54) CIRCUIT AND METHOD FOR IMPROVING THE PERFORMANCE OF A LIGHT EMITTING DIODE (LED) DRIVER

(75) Inventors: Siu-Hong Wong, Sha Tin (HK); Tze-Kau Man, Yuen Long (HK)

(73) Assignee: National Semiconductor Corporation, Santa Clara, CA (US)

( * ) Notice: Subject to any disclaimer, the term of this patent is extended or adjusted under 35 U.S.C. 154(b) by 339 days.

(21) Appl. No.: 12/317,106

(22) Filed: Dec. 19, 2008

(51) Int. Cl.
*H05B 37/00* (2006.01)
*H05B 41/24* (2006.01)

(52) U.S. Cl. ..... 315/247; 315/246

(58) Field of Classification Search ..... 315/200 R, 315/246, 247, 7
See application file for complete search history.

(56) References Cited

U.S. PATENT DOCUMENTS 4,023,111 A 5/1977 Mortensen
4,533,839 A 8/1985 Balakrishnan
5,396,188 A 3/1995 Aoki
5,420,499 A 5/1995 DeShazo
6,084,465 A 7/2000 Dasgupta
6,314,010 B1 11/2001 Markow et al.
6,583,609 B1 6/2003 Pardoen
6,606,257 B2 8/2003 Bourdillon
6,661,679 B1 12/2003 Yang et al.
6,683,419 B2 1/2004 Kriparos
6,844,760 B2 1/2005 Koharagi et al.
6,864,641 B2 * 3/2005 Dygert ..... 315/216
6,871,289 B2 3/2005 Pullen et al.
6,970,339 B2 11/2005 Wong et al.
6,977,491 B1 12/2005 Caldwell et al.
6,989,807 B2 * 1/2006 Chiang ..... 345/82
6,989,998 B2 * 1/2006 Leisten et al. ..... 363/47
7,030,596 B1 4/2006 Salerno et al.
7,058,373 B2 6/2006 Grigore
7,115,888 B2 10/2006 Hachiya et al.
7,132,820 B2 11/2006 Walters et al.
7,170,267 B1 1/2007 McJimsey
7,176,664 B1 2/2007 Potanin et al.
7,196,483 B2 * 3/2007 Wey et al. ..... 315/312
7,388,359 B1 6/2008 Ling
7,425,819 B2 9/2008 Isobe
7,443,209 B2 10/2008 Chang
7,595,622 B1 9/2009 Tomiyoshi et al.

(Continued)

OTHER PUBLICATIONS

Tawen Mai et al., "System and Method for Providing a Process, Temperature and Over-Drive Invariant Over-Current Protection Circuit", U.S. Appl. No. 11/784,766, filed Apr. 9, 2007.

(Continued)

*Primary Examiner* — Douglas W Owens
*Assistant Examiner* — Minh M A

(57) ABSTRACT

A circuit includes a driver configured to generate an output for driving one or more light emitting diodes. The circuit also includes a voltage booster configured to boost an input voltage provided to the driver when the voltage booster is coupled to a high-frequency pulsating alternating current (AC) voltage source that provides the input voltage. The voltage booster may include two first diodes coupled in series, two second diodes coupled in series, and first and second capacitors coupled in series. A first input voltage terminal may be coupled between the first diodes, and a second input voltage terminal may be coupled between the second diodes and between the capacitors. The voltage booster may be further configured to provide the input voltage to the driver without boosting when the voltage booster is coupled to a direct current (DC) or low-frequency AC voltage source that provides the input voltage.

20 Claims, 7 Drawing Sheets

U.S. PATENT DOCUMENTS

| | | | | |
|---|---|---|---|---|
| 7,633,463 | B2 * | 12/2009 | Negru | 345/46 |
| 2004/0189555 | A1 * | 9/2004 | Capen et al. | 345/82 |
| 2007/0132439 | A1 | 6/2007 | Tsuzaki | |

OTHER PUBLICATIONS

Jonathan Knight, "Versatile System for High-Accuracy Current Limiting Circuitry", U.S. Appl. No. 11/268,761, filed Nov. 7, 2005.

Tawen Mei, et al., "Circuit and Method for Average-Current Regulation of Light Emitting Diodes", U.S. Appl. No. 11/703,981, filed Feb. 8, 2007.

Lawrence Hok-Sun Ling, "System and Method for Providing a Pulsating Current Output Having Ultra Fast Rise and Fall Times", U.S. Appl. No. 11/731,961, filed Apr. 2, 2007.

Lik-Kin Wong, et al., "Circuit and Method for Adaptive Current Limit Control in a Power Converter", U.S. Appl. No. 11/803,317, filed May 14, 2007.

"PWM LED Driver and Boost, Flyback and SEPIC Controller", Linear Technology Corporation 2005, 24 pages.

"Constant Current LED Driver with Digital and PWM Brightness Control", Texas Instruments, Nov. 2004, 25 pages.

Prathyusha Narra, et al., "An Effective LED Dimming Approach", 2004 IEEE, p. 1671-1676.

T. Suntio et al., "Dynamic Effects of Inductor Current Ripple in Average Current Mode Control", 2001 IEEE, pp. 1259-1264.

Zaohong Yang et al., "DC-to-DC Buck Converters with Novel Current Mode Control", 1999 IEEE, pp. 1158-1164.

Yang Yinfu et al., "Pulse by Pulse Current Limiting Technique for SPWM Inverters," IEEE 1999 International Conference on Power Electronics and Drive Systems, PEDS'99, Jul. 1999, Hong Kong, pp. 1021-1026.

* cited by examiner

CIRCUIT AND METHOD FOR IMPROVING THE PERFORMANCE OF A LIGHT EMITTING DIODE (LED) DRIVER

TECHNICAL FIELD

This disclosure is generally directed to light emitting diode (LED) driving circuits and more specifically to a circuit and method for improving the performance of an LED driver.

BACKGROUND

Many conventional lighting systems with filament light bulbs use simple self-oscillating, push-pull switching mode converters (known as electronic transformers) as their power supplies. Electronic transformers are typically low-cost and efficient, which is why they are commonly used in residential and commercial environments. However, electronic transformers are not optimized for use with light emitting diode (LED) lighting systems. More specifically, electronic transformers typically cause LEDs to turn on and off twice every cycle of an alternating current (AC) input voltage. This reduces the average brightness of the LEDs and causes visible flickering in the light produced by the LEDs.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 15, discussed below, and the various embodiments used to describe the principles of the present invention in this patent document are by way of illustration only and should not be construed in any way to limit the scope of the present invention. Those skilled in the art will understand that the principles of the present invention may be implemented in any type of suitably arranged device or system.

Figure 1:
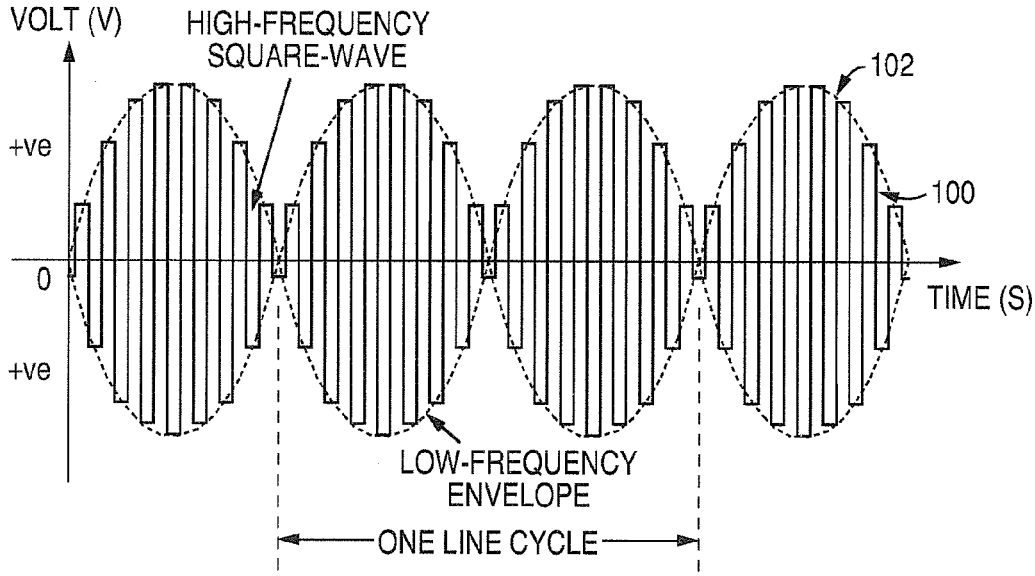
FIG. 1 PRIOR ART)
FIGS. 1 through 4 illustrate voltages associated with operation of a conventional electronic transformer and light emitting diode (LED) driver.
Figure 2:
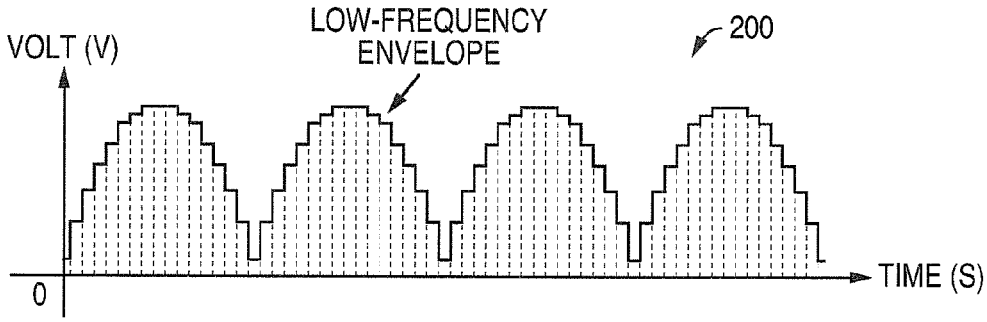
FIG. 2 PRIOR ART)
Figure 3:
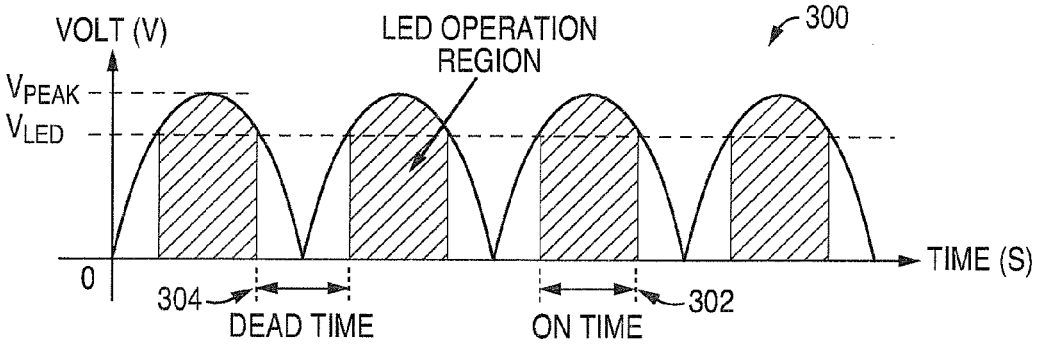
FIG. 3 PRIOR ART)
Figure 4:
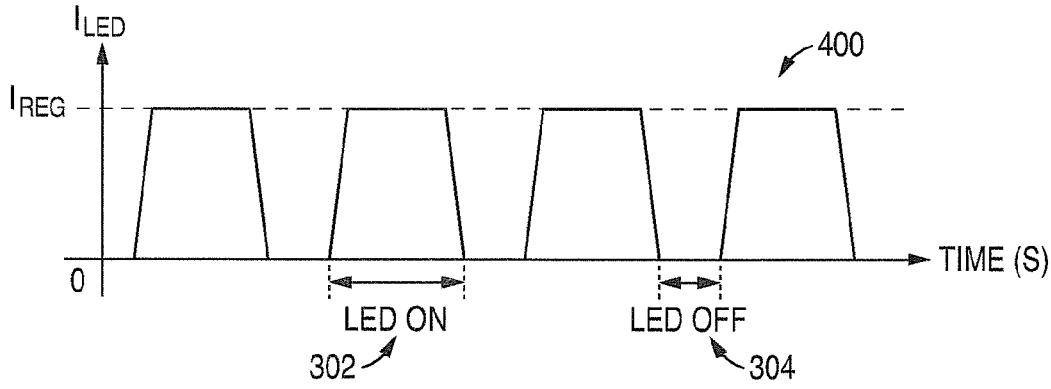
FIG. 4 PRIOR ART)

FIGS. 1 through 4 illustrate voltages associated with operation of a conventional electronic transformer and light emitting diode (LED) driver. As shown in FIG. 1, the conventional electronic transformer generates an alternating current (AC) output voltage 100. The output voltage 100 represents a square pulse stream (typically of several tenths of a kilohertz), where the change of the output voltage 100 follows the shape of an envelope 102 of the electronic transformer. The output voltage 100 from the electronic transformer undergoes rectification to produce a voltage waveform 200 shown in FIG. 2. FIG. 3 illustrates an input voltage 300 (based on the voltage waveform 200) supplied to a conventional buck LED driver, and FIG. 4 illustrates an output current 400 produced by the conventional buck LED driver.

Since the output voltage 100 from the electronic transformer varies following the envelope 102, the voltage 100 often falls below the forward voltage of one or more LEDs being driven, causing the LEDs to turn off periodically. As can be seen in FIG. 3, the input voltage 300 exceeds the voltage needed to turn on the one or more LEDs (denoted $V_{LED}$) only during certain "on" times 302. As can be seen in FIG. 4, the output current 400 of the LED driver reaches a regulated current level that turns on the one or more LEDs (denoted $I_{REG}$) only during those "on" times 302. The other times are called "dead" times 304 since they denote periods when the LEDs are not emitting light. This creates dead time twice during each cycle of the voltage 200, which produces visible light flickering and reduces the average brightness of the LEDs.

Figure 5:
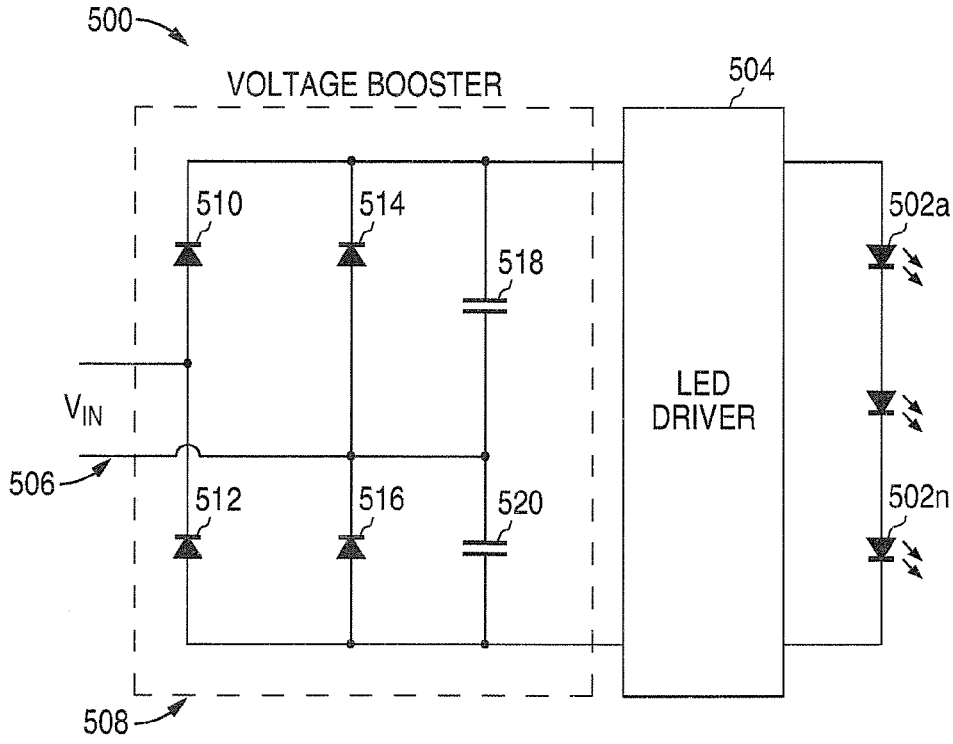
FIG. 5 illustrates an example LED driving system in accordance with this disclosure.

FIG. 5 illustrates an example LED driving system 500 in accordance with this disclosure. The embodiment of the LED driving system 500 shown in FIG. 5 is for illustration only. Other embodiments of the LED driving system 500 could be used without departing from the scope of this disclosure.

As shown in FIG. 5, the LED driving system 500 powers one or more LEDs 502*a*-502*n*. Any suitable number and type(s) of LEDs 502*a*-502*n* could be used in the system 500. Also, the LEDs 502*a*-502*n* could have any suitable configuration, such as configurations where the LEDs 502*a*-502*n* are coupled in series, in parallel, or in series and in parallel. Further, the LEDs 502*a*-502*n* could produce light in any suitable wavelength range or ranges. In addition, the LEDs 502*a*-502*n* could be used for a wide variety of purposes, such as handheld and space lighting applications. Each LED 502*a*-502*n* represents any suitable semiconductor structure for producing light.

The LEDs 502*a*-502*n* are driven by an LED driver 504. The LED driver 504 drives the LEDs 502*a*-502*n* by receiving an input voltage and producing an output current. The light produced by the LEDs 502*a*-502*n* can be controlled by varying the characteristic(s) of the output current traveling through the LEDs 502*a*-502*n*, such as the average forward current. The LED driver 504 includes any suitable structure for driving one or more light emitting diodes, such as a buck LED driver.

The LED driving system 500 receives an input voltage 506, which powers the LED driving system 500. The input voltage 506 could represent a high-frequency pulsating alternating current (AC) voltage with a low-frequency envelope. However, the LED driving system 500 could also be powered by a direct current (DC) input voltage or a low-frequency AC voltage. The input voltage 506 could be provided from any suitable power source.

To reduce or eliminate problems such as visible light flickering and reduced brightness, the LED driving system 500 includes a voltage booster 508. In general, the voltage booster 508 increases the utilization of the LEDs 502*a*-502*n* and reduces the dead time associated with the LEDs 502*a*-502*n* by pushing up the input voltage provided to the LED driver 504 when the input voltage 506 represents a high-frequency pulsating AC voltage. In this example, the voltage booster 508 includes four diodes 510-516 and two capacitors 518-520. The diodes 510-516 could represent any suitable diodes. The capacitors 518-520 could represent any suitable capacitors, such as ceramic capacitors, with any suitable capacitance(s).

The diodes 510-512 are coupled in series, and the diodes 514-516 are coupled in series. The capacitors 518-520 are coupled in series and are positioned in parallel with the two pairs of diodes 510-516. A first input voltage terminal is coupled between the diodes 510-512. A second input voltage terminal is coupled between the diodes 514-516 and between the capacitors 518-520.

Figure 6:
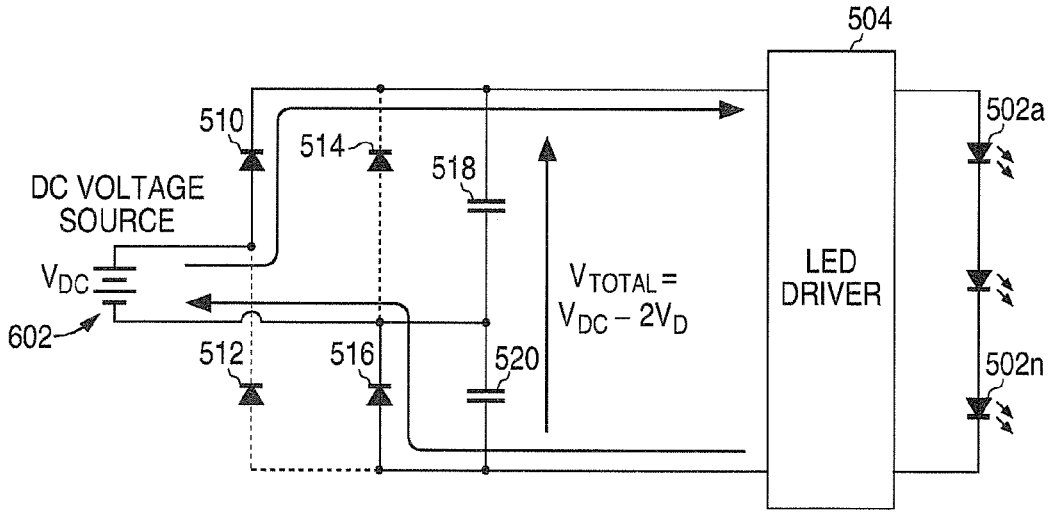
FIGS. 6 through 10 illustrate example operations of the LED driving system of FIG. 5 in accordance with this disclosure.
Figure 7:
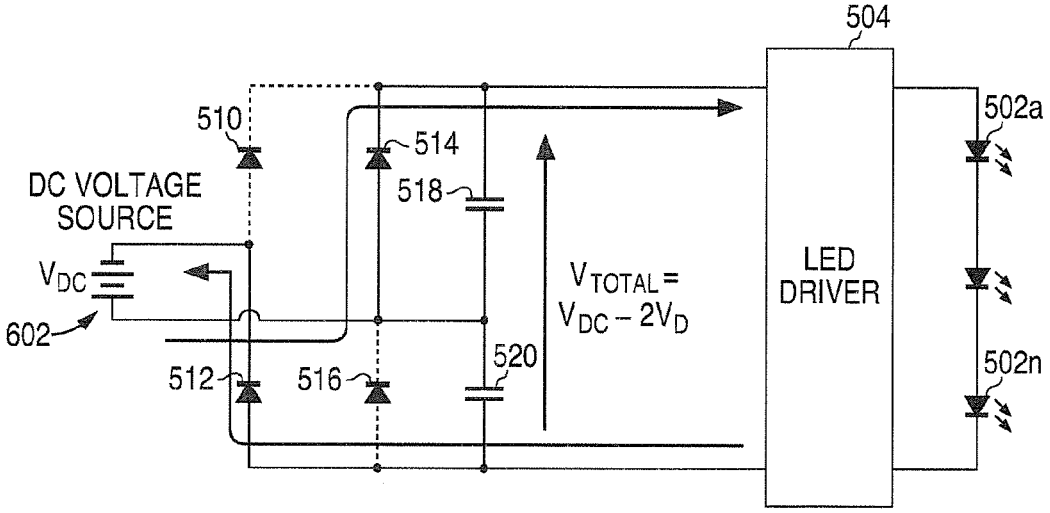
Figure 8:
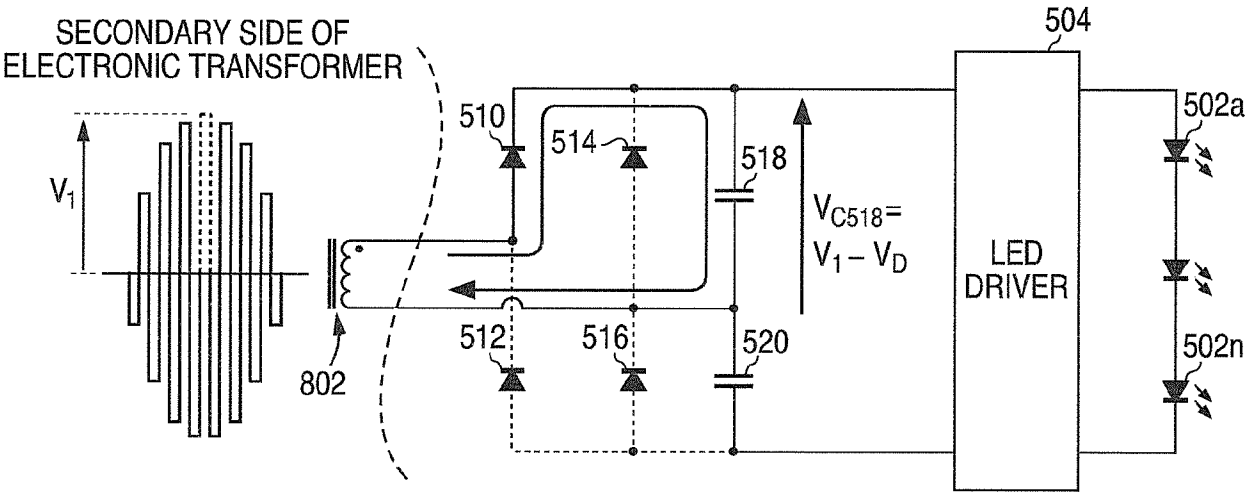
Figure 9:
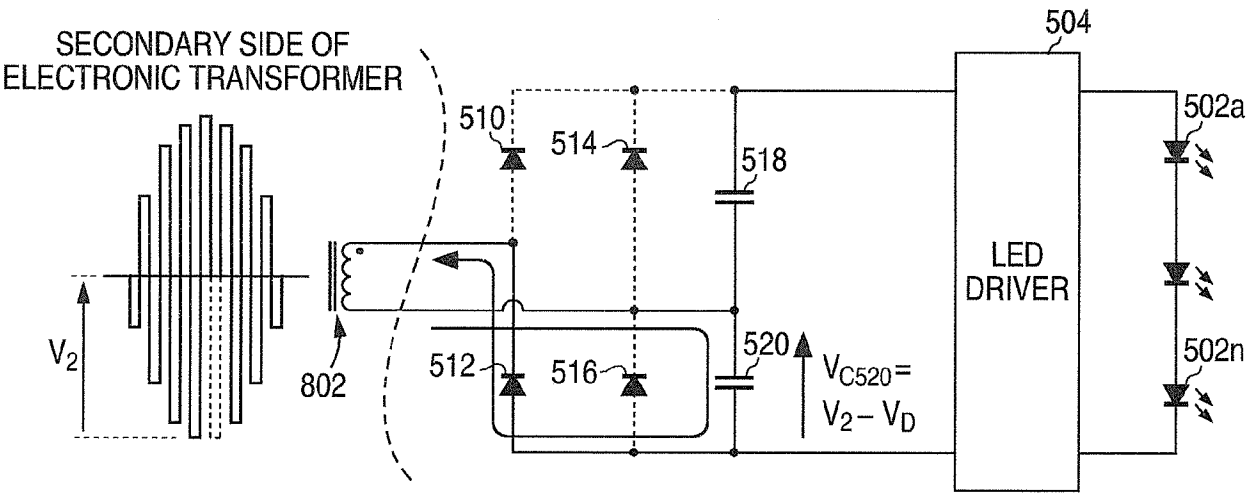
Figure 10:
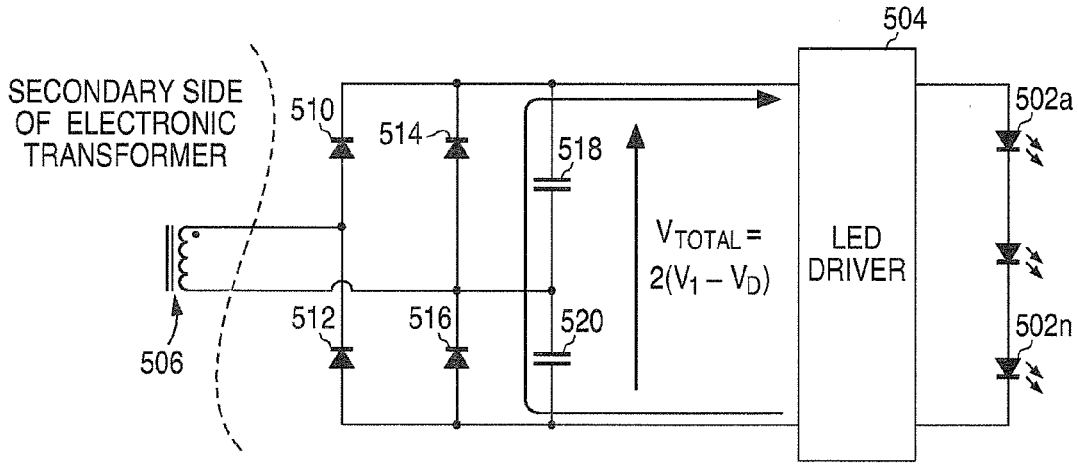

The operation of the voltage booster 508 varies depending on the input voltage. FIGS. 6 through 10 illustrate example operations of the LED driving system 500 of FIG. 5 in accordance with this disclosure. In particular, FIGS. 6 and 7 illustrate operation of the LED driving system 500 with a DC or low-frequency AC input voltage, and FIGS. 8 through 10 illustrate operation of the LED driving system 500 with a high-frequency pulsating AC input voltage.

As shown in FIGS. 6 and 7, a DC or low-frequency AC voltage source 602 is providing power to the LED driving system 500. The difference between FIGS. 6 and 7 is the polarity of the voltage source 602, meaning the positive and negative terminals of the voltage source 602 are reversed. In FIG. 6, current flows from the voltage source 602 to the LED driver 504 through the diode 510 and from the LED driver 504 to the voltage source 602 through the diode 516. In FIG. 7, current flows from the voltage source 602 to the LED driver 504 through the diode 514 and from the LED driver 504 to the voltage source 602 through the diode 512. In either case, the voltages across the capacitors 518-520 are limited by their parallel diodes. The voltage booster 508 therefore behaves like a normal bridge rectifier, which has a voltage drop of $2V_D$ (where $V_D$ denotes the voltage drop across each diode).

As shown in FIGS. 8 and 9, a transformer 802 is providing power to the LED driving system 500. The transformer 802 produces a high-frequency pulsating AC voltage source. Here, the operation of the voltage booster 508 is generally divided into two operational states. In FIG. 8, current flows from the transformer 802 through the diode 510 and the capacitor 518 and back to the transformer 802. During this first operational state, the capacitor 518 is charged to a voltage $V_{C518}$ that is near the positive peak $V_1$ of the input voltage (with the difference mainly resulting from the voltage drop $V_D$ across the diode 510). In FIG. 9, current flows from the transformer 802 through the capacitor 520 and the diode 512 and back to the transformer 802. During this second operational state, the capacitor 520 is charged to a voltage $V_{C520}$ that is near the negative peak $V_2$ of the input voltage (with the difference mainly resulting from the voltage drop $V_D$ across the diode 512). As shown in FIG. 10, assuming the magnitude of $V_1$ and $V_2$ are identical, the total voltage $V_{TOTAL}$ across the capacitors 518-520 can be expressed as $2(V_1-V_D)$.

In this way, the voltage booster 508 can boost the peak of an input voltage provided to the LED driver 504 (when used with a high-frequency pulsating AC input voltage) to improve LED brightness and reduce or eliminate visible flickering. Moreover, the voltage booster 508 could be used with DC and low-frequency input voltages. FIGS. 11 through 14 illustrate typical waveforms associated with operation of the LED driving system 500 of FIG. 5 in accordance with this disclosure. In particular, these figures illustrate how the operation of the LED driving system 500 provides for the improved driving of LEDs.

Figure 11:
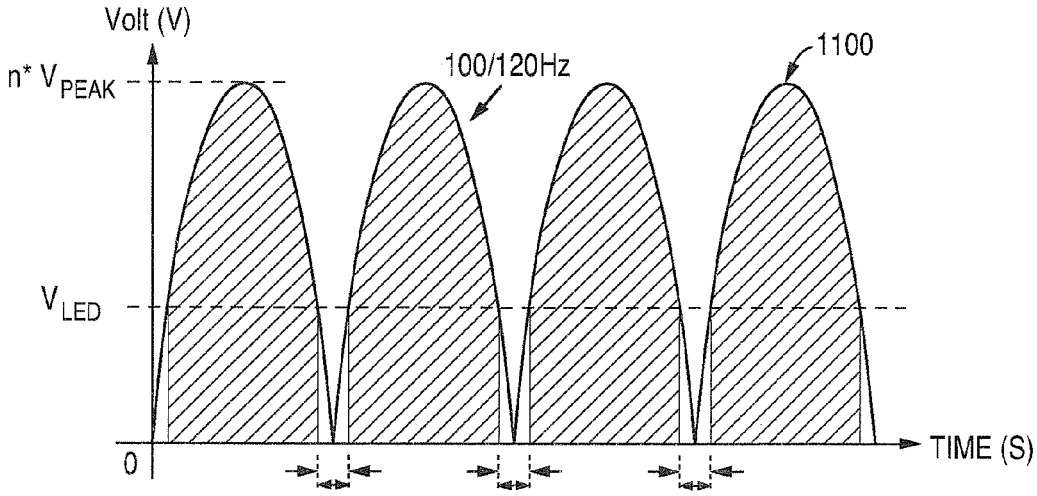
FIGS. 11 through 14 illustrate typical waveforms associated with operation of the LED driving system of FIG. 5 in accordance with this disclosure.
Figure 12:
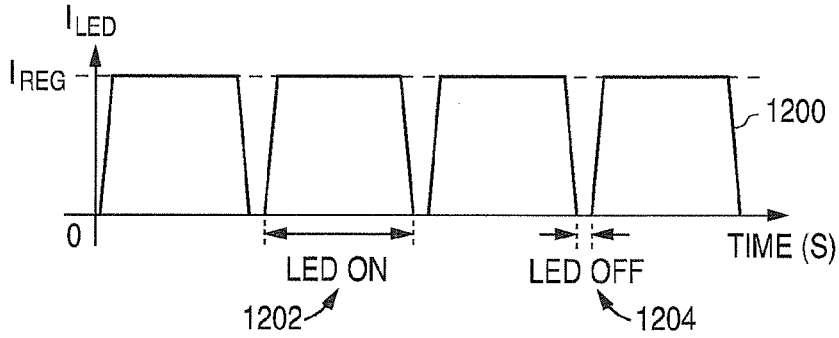

FIG. 11 illustrates a typical input voltage waveform 1100 provided to the LED driver 504 by the voltage booster 508 in FIG. 5. As can be seen here, the input voltage waveform 1100 to the LED driver has been pushed up by the voltage booster 508 to a higher peak (denoted $n*V_{PEAK}$) compared to FIG. 3. FIG. 12 illustrates a typical output current waveform 1200 delivered to the LEDs 502*a*-502*n* by the LED driver 504. Compared to FIG. 4, the "on" time 1202 is increased significantly and the "dead" time 1204 is reduced significantly by pushing the input voltage so that its peak is much higher than the forward voltage needed to turn on the LEDs 502*a*-502*n*.

Figure 13:
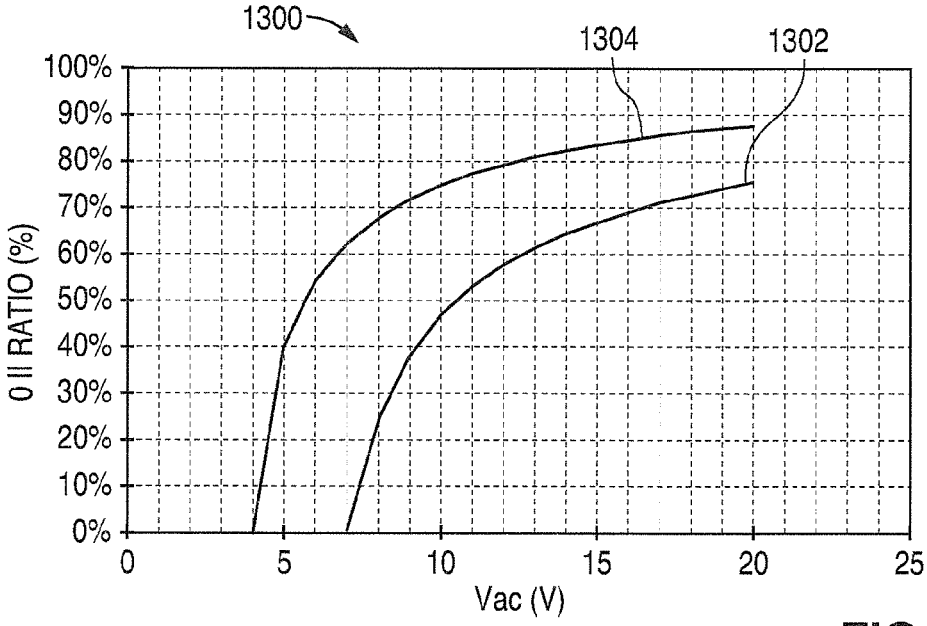

FIG. 13 contains a graph 1300 illustrating the typical operation of an LED driving system without a voltage booster and the typical operation of the LED driving system 500 with the voltage booster 508. In particular, line 1302 represents the "on" ratio of LEDs driven by an LED driving system without a voltage booster, and line 1304 represents the "on" ratio of LEDs driven by the LED driving system 500. The "on" ratio is defined as the "on" time of the LEDs divided by a sum of the "on" and "dead" times of the LEDs. In this example, with a 12V input, the "on" ratio improves by approximately 21% using the voltage booster 508. This indicates that the LEDs driven by the LED driving system 500 could be approximately 21% brighter at the same input voltage compared to conventional LED driving systems.

Figure 14:
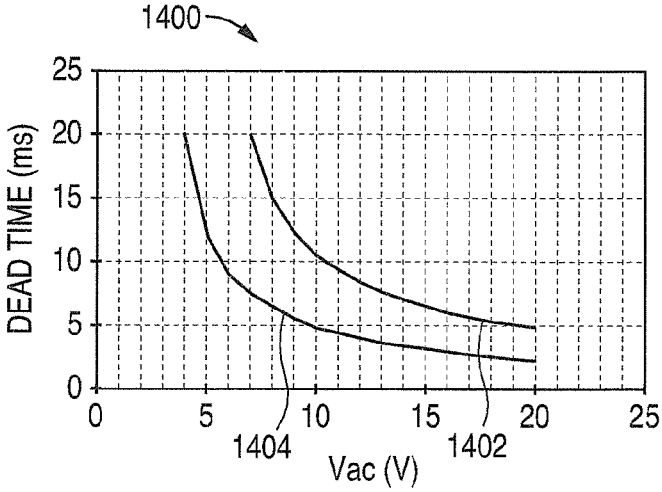

FIG. 14 contains a graph 1400 illustrating typical start-up voltages for an LED driving system without a voltage booster and for the LED driving system 500 with the voltage booster 508. In particular, line 1402 represents the operation of LEDs driven by an LED driving system without a voltage booster, and line 1404 represents the operation of LEDs driven by the LED driving system 500. The voltage where each line begins to drop in FIG. 14 represents the start-up voltage necessary to turn on the LEDs. In this example, the start-up voltage is reduced by approximately 3V AC using the voltage booster 508.

In this way, the LED driving system 500 provides an effective technique to improve the performance and utilization of, for example, buck LED drivers with AC power sources. In particular, this technique can be used to help increase the utilization of LEDs when an input voltage is a high-frequency pulsating AC input voltage, although the technique can be used with DC or low-frequency AC input voltage. This allows flexibility in its use and operation. This technique can also be used to reduce or eliminate the flickering effect of LED lighting systems by reducing the dead-time of the LEDs. This can be done without the use of complicated external circuits or the associated increase in total component count. This makes this approach very cost competitive and easy to implement practically.

Although these figures illustrate an example embodiment of an LED driving system 500 and various features of its operation, various changes may be made to these figures. For example, any suitable number and arrangement of LEDs could be used, and any suitable source of power could be provided. Also, any suitable rectification circuit and any suitable combination of capacitors could be used in the voltage booster 508. Further, operation of particular implementations of the LED driving system 500 could vary from that shown in FIGS. 11 through 14, such as when different implementations use different component values or LED arrangements.

Figure 15:
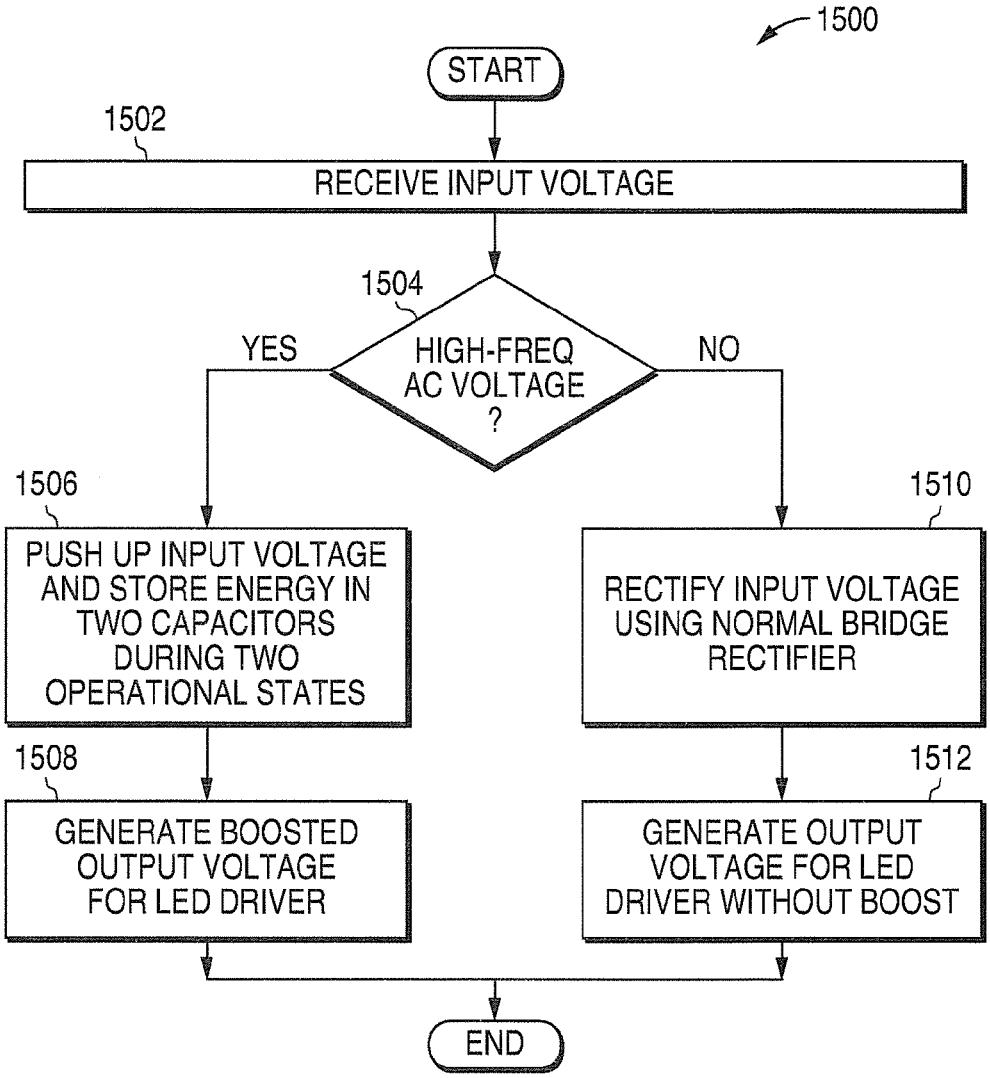
FIG. 15 illustrates an example method for improved LED driving in accordance with this disclosure.

FIG. 15 illustrates an example method 1500 for improved LED driving in accordance with this disclosure. The embodiment of the method 1500 shown in FIG. 15 is for illustration only. Other embodiments of the method 1500 could be used without departing from the scope of this disclosure.

An input voltage is received at step 1502. This could include, for example, the voltage booster 508 receiving a DC, low-frequency AC, or high-frequency pulsating AC voltage. Depending on the input voltage at step 1504, the voltage booster may perform steps 1506-1508 or steps 1510-1512. Note that step 1504 may not involve an actual determination of the type of input voltage received, but rather simply represents that the operation of the voltage booster 508 may vary depending on the input voltage received.

If a high-frequency pulsating AC voltage is received, the voltage booster pushes up the input voltage while storing energy in two capacitors during two operational states at step

1506. This may include, for example, the voltage booster 508 charging the capacitor 518 to approximately $V_1-V_D$ during the first operational state, where $V_1$ represents the positive peak in the input voltage. This could also include the voltage booster 508 charging the capacitor 520 to approximately $V_2-V_D$ during the second operational state, where $V_2$ represents the negative peak in the input voltage. A boosted output voltage for an LED driver is then generated at step 1508. This may include, for example, the voltage booster 508 producing an output voltage with higher peaks compared to the original input voltage.

If a DC or low-frequency AC voltage is received, the voltage booster rectifies the input voltage at step 1510. This may include, for example, the diodes in the voltage booster 508 functioning as a regular bridge rectifier. An output voltage for the LED driver is then generated at step 1512. This may include, for example, the voltage booster 508 producing an output voltage without any boosting.

Although FIG. 15 illustrates one example method 1500 for improved LED driving, various changes may be made to FIG. 15. For example, more than two capacitors could be used in the voltage booster 508.

It may be advantageous to set forth definitions of certain words and phrases that have been used within this patent document. The term "couple" and its derivatives refer to any direct or indirect communication between two or more components, whether or not those components are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this invention. Other changes, substitutions, and alterations are also possible without departing from the spirit and scope of this invention as defined by the following claims.

What is claimed is:

1. A circuit comprising:

a driver configured to generate an output for driving one or more light emitting diodes; and a voltage booster configured to boost an input voltage provided to the driver;

wherein the voltage booster comprises two first diodes coupled in series, two second diodes coupled in series, and first and second capacitors coupled in series;

wherein a first input voltage terminal is coupled between the first diodes and a second input voltage terminal is coupled between the second diodes and between the capacitors;

wherein the voltage booster is configured to charge the first and second capacitors during first and second operational states, respectively;

wherein the voltage booster is configured to charge the first capacitor to a voltage approximately equal to $V_1-V_D$ during the first operational state and to charge the second capacitor to a voltage approximately equal to $V_2-V_D$ during the second operational state, where $V_1$ represents a positive peak in the input voltage, $V_2$ represents a negative peak in the input voltage, and $V_D$ represents a voltage drop across at least one of the diodes; and wherein the voltage booster is configured to decrease a start-up voltage needed to turn on the one or more light emitting diodes by at least approximately 3V AC compared to a start-up voltage needed to turn on the one or more light emitting diodes without boosting of the input voltage.

2. The circuit of claim 1, wherein:

current flows from one of the input voltage terminals through one of the first diodes and through the first capacitor during the first operational state; and current flows from another of the input voltage terminals through one of the second diodes and through the second capacitor during the second operational state.

3. The circuit of claim 1, wherein:

the voltage booster is configured to boost the input voltage provided to the driver when the voltage booster is coupled to a higher-frequency pulsating alternating current (AC) voltage source; and the voltage booster is further configured to provide the input voltage to the driver without boosting when the voltage booster is coupled to a direct current (DC) or lower-frequency AC voltage source.

4. The circuit of claim 3, wherein the first and second diodes are configured to function as a bridge rectifier when the voltage booster is coupled to the DC or lower-frequency AC voltage source.

5. The circuit of claim 3, wherein, when the voltage booster is coupled to the DC or lower-frequency AC voltage source:

current flows from one of the input voltage terminals to the driver through one of the first diodes; and current flows from the driver to another of the input voltage terminal through one of the second diodes.

6. The circuit of claim 1, wherein the voltage booster is configured to increase a brightness of the one or more light emitting diodes by about 21% compared to a brightness of the one or more light emitting diodes without boosting of the input voltage.

7. The circuit of claim 1, wherein the voltage booster is configured to decrease the start-up voltage needed to turn on the one or more light emitting diodes by about 3V AC compared to the start-up voltage needed to turn on the one or more light emitting diodes without boosting of the input voltage.

8. A system comprising:

one or more light emitting diodes; and a driving system comprising:

a driver configured to generate an output for driving the one or more light emitting diodes; and a voltage booster configured to boost an input voltage provided to the driver;

wherein the voltage booster comprises two first diodes coupled in series, two second diodes coupled in series, and first and second capacitors coupled in series;

wherein a first input voltage terminal is coupled between the first diodes and a second input voltage terminal is coupled between the second diodes and between the capacitors;

wherein the voltage booster is configured to charge the first and second capacitors during first and second operational states, respectively;

wherein the voltage booster is configured to charge the first capacitor to a voltage approximately equal to $V_1-V_D$ during the first operational state and to charge the second capacitor to a voltage approximately equal to $V_2-V_D$ during the second operational state, where $V_1$ represents a positive peak in the input voltage, $V_2$ represents a negative peak in the input voltage, and $V_D$ represents a voltage drop across at least one of the diodes; and wherein the voltage booster is configured to decrease a start-up voltage needed to turn on the one or more light emitting diodes by at least approximately 3V AC compared to a start-up voltage needed to turn on the one or more light emitting diodes without boosting of the input voltage.

9. The system of claim 8, wherein:

current flows from one of the input voltage terminals through one of the first diodes and through the first capacitor during the first operational state; and current flows from another of the input voltage terminals through one of the second diodes and through the second capacitor during the second operational state.

10. The system of claim 8, wherein:

the voltage booster is configured to boost the input voltage provided to the driver when the voltage booster is coupled to a higher-frequency pulsating alternating current (AC) voltage source; and the voltage booster is further configured to provide the input voltage to the driver without boosting when the voltage booster is coupled to a direct current (DC) or lower-frequency AC voltage source.

11. The system of claim 10, wherein the first and second diodes are configured to function as a bridge rectifier when the voltage booster is coupled to the DC or lower-frequency AC voltage source.

12. The system of claim 10, wherein, when the voltage booster is coupled to the DC or lower-frequency AC voltage source:

current flows from one of the input voltage terminals to the driver through one of the first diodes; and current flows from the driver to another of the input voltage terminal through one of the second diodes.

13. The system of claim 8, wherein the voltage booster is configured to increase a brightness of the one or more light emitting diodes by about 21% compared to a brightness of the one or more light emitting diodes without boosting of the input voltage.

14. The system of claim 8, wherein the voltage booster is configured to decrease the start-up voltage needed to turn on the one or more light emitting diodes by about 3V AC compared to the start-up voltage needed to turn on the one or more light emitting diodes without boosting of the input voltage.

15. A method comprising:

receiving an input voltage;

generating a boosted input voltage using a voltage booster, the voltage booster comprising two first diodes coupled in series, two second diodes coupled in series, and first and second capacitors coupled in series;

generating an output based on the boosted input voltage; and providing the output to one or more light emitting diodes;

wherein a first input voltage terminal is coupled between the first diodes and a second input voltage terminal is coupled between the second diodes and between the capacitors of the voltage booster;

wherein generating the boosted input voltage comprises:

charging the first and second capacitors during first and second operational states, respectively;

generating current that flows from one of the input voltage terminals through one of the first diodes and through the first capacitor during the first operational state; and generating current that flows from another of the input voltage terminals through one of the second diodes and through the second capacitor during the second operational state; and wherein generating the boosted input voltage decreases a start-up voltage needed to turn on the one or more light emitting diodes by at least approximately 3V AC compared to a start-up voltage needed to turn on the one or more light emitting diodes without boosting the input voltage.

16. The method of claim 15, wherein:

the voltage booster is configured to generate the boosted input voltage when the voltage booster is coupled to a higher-frequency pulsating alternating current (AC) voltage source; and the voltage booster is further configured to operate the first and second diodes as a bridge rectifier when the voltage booster is coupled to a direct current (DC) or lower-frequency AC input voltage source.

17. The method of claim 15, wherein generating the boosted input voltage comprises using the voltage booster to:

charge the first capacitor to a voltage approximately equal to $V_1-V_D$ during the first operational state; and charge the second capacitor to a voltage approximately equal to $V_2-V_D$ during the second operational state;

where $V_1$ represents a positive peak in the input voltage, $V_2$ represents a negative peak in the input voltage, and $V_D$ represents a voltage drop across at least one of the diodes.

18. The method of claim 17, wherein all of the first and second diodes have an equal voltage drop $V_D$.

19. The method of claim 15, wherein generating the boosted input voltage increases a brightness of the one or more light emitting diodes by about 21% compared to a brightness of the one or more light emitting diodes without boosting the input voltage.

20. The method of claim 15, wherein generating the boosted input voltage decreases the start-up voltage needed to turn on the one or more light emitting diodes by about 3V AC compared to the start-up voltage needed to turn on the one or more light emitting diodes without boosting the input voltage.

* * * * *